US009448538B2

(12) United States Patent
Honda

(10) Patent No.: US 9,448,538 B2
(45) Date of Patent: Sep. 20, 2016

(54) ELECTRONIC TIMEPIECE AND TIME ADJUSTMENT METHOD

(75) Inventor: Katsuyuki Honda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 221 days.

(21) Appl. No.: 13/449,919

(22) Filed: Apr. 18, 2012

(65) Prior Publication Data

US 2012/0269042 A1 Oct. 25, 2012

(30) Foreign Application Priority Data

Apr. 21, 2011 (JP) ..... 2011-095178

(51) Int. Cl.
*G04G 5/02* (2006.01)
*G04G 5/00* (2013.01)
*G04R 20/02* (2013.01)

(52) U.S. Cl.
CPC ..... *G04G 5/002* (2013.01); *G04R 20/02* (2013.01)

(58) Field of Classification Search
CPC ..... G04G 5/002; G04G 21/04; G04G 7/02
USPC ..... 368/47; 455/13.2; 342/357.2
See application file for complete search history.

(56) References Cited

U.S. PATENT DOCUMENTS 5,297,120 A 3/1994 Yuzuki et al.
6,552,681 B1 4/2003 Hayward et al.
7,457,203 B2 11/2008 Nakagawa
7,616,153 B2 11/2009 Honda et al.
8,077,551 B2 * 12/2011 Fujisawa ..... 368/47
8,953,999 B2 2/2015 Akiyama et al.
2001/0050694 A1 12/2001 Iwaki et al.
2003/0198140 A1 * 10/2003 Shimizu ..... 368/47
2003/0219039 A1 11/2003 Oguchi
2009/0034372 A1 * 2/2009 Fujisawa ..... 368/14
2009/0129206 A1 5/2009 Baba
2009/0135674 A1 5/2009 Matsuzaki
2009/0160705 A1 6/2009 Matsuzaki
2009/0180356 A1 * 7/2009 Fujisawa ..... 368/47
2010/0220555 A1 9/2010 Honda

FOREIGN PATENT DOCUMENTS

EP 1168114 A2 1/2002
EP 1349022 A2 10/2003
EP 1349022 A3 6/2004
EP 1168114 A3 7/2004
EP 1669818 A1 6/2006
EP 2081091 A1 7/2009

(Continued)

*Primary Examiner* — Sean Kayes

(57) ABSTRACT

An electronic timepiece efficiently receives satellite signals, reduces power consumption, and displays the correct time. A GPS wristwatch 1 has a satellite signal reception unit 10A that receives satellite signals and acquires time information contained in the satellite signals; a time information adjustment unit 25 that keeps times and adjusts the kept time based on the time information acquired by the automatic receiving unit 24; a reception result memory unit 313 that stores the reception result of the reception process performed by the automatic receiving unit 24; and a reception time setting unit 21 that sets the reception start time at which the reception process starts based on the reception result stored in the reception result memory unit 313. The automatic receiving unit 24 executes the reception process when the kept time reaches the reception start time set by the reception time setting unit 21.

9 Claims, 10 Drawing Sheets

(56) References Cited

FOREIGN PATENT DOCUMENTS

| | | |
|---|---|---|
| JP | 05-249262 | 9/1993 |
| JP | 06-265650 | 9/1994 |
| JP | 07-198877 | 8/1995 |
| JP | 2001-357425 | 12/2001 |
| JP | 2003-279673 | 10/2003 |
| JP | 2004-003927 | 1/2004 |
| JP | 2004-003928 | 1/2004 |
| JP | 2004-003929 | 1/2004 |
| JP | 2004-340705 | 12/2004 |
| JP | 2005-062078 | 3/2005 |
| JP | 2005-233825 | 9/2005 |
| JP | 2006-090770 | 4/2006 |
| JP | 2006-194697 | 7/2006 |
| JP | 2006-349445 | 12/2006 |
| JP | 2007-225409 | 9/2007 |
| JP | 2008-039565 | 2/2008 |
| JP | 2008-215973 | 9/2008 |
| JP | 2009-128179 | 6/2009 |
| JP | 2009-145318 | 7/2009 |
| JP | 2009-168620 | 7/2009 |
| JP | 2009-175030 | 8/2009 |
| JP | 2009-180511 | 8/2009 |
| JP | 2009-216432 | 9/2009 |
| JP | 2010-066151 | 3/2010 |
| JP | 2010-203856 | 9/2010 |
| JP | 2011-163803 | 8/2011 |

* cited by examiner

ELECTRONIC TIMEPIECE AND TIME ADJUSTMENT METHOD

BACKGROUND

1. Technical Field

The present invention relates to an electronic timepiece that receives signals sent from GPS satellites or other positioning satellites and derives the current date and time from the signals, and to a time adjustment method.

2. Related Art

GPS satellites with known orbits around the Earth are used in the GPS system, which is a system for determining one's position, and each GPS satellite carries an atomic clock. Each GPS satellite therefore also keeps extremely precise time information (also referred to as the GPS time or satellite time).

Mobile electronic devices having a unit that uses time information contained in navigation data sent from GPS satellites to correct internal time data kept by a timekeeping unit are known from the literature. See, for example, Japanese Unexamined Patent Appl. Pub. JP-A-2006-194697.

JP-A-2006-194697 teaches a control method that uses a UV sensor to determine an indoor or outdoor location, and receives GPS signals only when outdoors.

JP-A-2006-194697 describes a method of selectively receiving outdoors navigation data sent from a satellite that is difficult to receive indoors, but there are situations in which reception is difficult due to indoor/outdoor recognition errors caused by indoor lighting, or the effect of multipath interference or a location with a narrow open angle to the zenith due to the effect of tall buildings when outdoors.

SUMMARY

With consideration for the foregoing problem, an electronic timepiece and time adjustment method according to the present invention enable efficiently receiving satellite signals and reducing power consumption, and displaying the accurate time.

One aspect of the invention is an electronic timepiece including: a reception unit that performs a reception process for receiving satellite signals sent from positioning satellites, and acquiring time information contained in the satellite signals; a timekeeping unit that keeps time and adjusts the kept time based on the time information acquired by the reception unit; a reception result storage unit that stores the reception result of the reception process performed by the reception unit; and a reception time setting unit that sets a reception start time for starting the reception process based on the reception result stored in the reception result storage unit; wherein the reception unit executes the reception process when the time kept by the timekeeping unit matches the reception start time.

This aspect of the invention has a reception time setting unit that sets the time the reception process starts based on the reception results stored in a reception result storage unit. The reception time setting unit can therefore set the time reception started when reception succeeded as the time to start reception thereafter. As a result, a period of time when reception has succeeded in the past can be set as the reception start time, the reception process can be run during a period of time in the user's pattern of activity when reception is easy, and the probability of successful reception is improved.

Compared with a configuration in which the reception start time is fixed, the electronic timepiece according to this aspect of the invention improves the probability that reception will succeed and time information can be acquired, can display the correct time, can prevent wasteful reception processes, and can save energy.

In an electronic timepiece according to another aspect of the invention, the reception time setting unit preferably does not change the reception start time when the reception process succeeds at the reception start time, updates the reception start time by shifting a previously set specific time when the reception process at the reception start time fails, and sets the updated reception start time as the reception start time for starting the reception process when reception at the updated reception start time succeeds.

If reception is performed at the same time as the last successful reception when the user's pattern of activity remains the same, the probability of successful reception is high. The invention keeps the same reception start time if reception succeeds in the reception process performed at the set reception start time (including the default reception start time). If reception fails, reception is attempted again after a specific time, such as one hour, the reception process thereafter repeats after increments of the specific time until reception succeeds, and when reception succeeds, that time is set as the reception start time.

The next reception start time therefore matches the time the last successful reception process was executed, reception can be done during the period when reception succeeded based on the user's pattern of activity, and the probability of successful reception can be improved.

Further preferably in an electronic timepiece according to another aspect of the invention, the reception result storage unit stores reception results for a specific period of time; and the reception time setting unit sets the next reception start time based on the reception results for the specific period of time.

This specific period of time may be any period of plural days, such as one week (seven days).

If the reception results for a specific period of time are stored in the reception result storage unit, a period of time when the probability of successful reception is high can be reliably determined. More specifically, because receiving satellite signals is easy when the electronic timepiece is located outdoors, reception is easier while walking from home to the station or while outdoors during lunch than when the user is working in an office building or is riding a train while commuting. Because the probability of successful reception changes with the user's pattern of activity, a time when reception will succeed for a particular user can be determined by storing the reception results for plural days.

Because the reception start time used thereafter can be set to the time of a reception process that was successful on plural days, reception can be performed during a time when reception can succeed based on the user's pattern of activity, and the probability of successful reception is high.

Further preferably in an electronic timepiece according to another aspect of the invention, the reception time setting unit has a plurality of times set as a default reception start time, and sets a time selected from among the plural times as the next reception start time when the reception process succeeded.

This aspect of the invention runs the reception process at plural times set as default times, such as at 8:00, 18:00, and 23:00. Of these times, the time when reception succeeded is set as the reception start time to be used thereafter. If reception succeeds at plural different times, the time suited to reception may be selected based on, for example, the time when the signal reception level was highest.

This aspect of the invention enables selecting the reception start time from among plural times. Compared with a configuration that sets the time when reception first succeeded as the reception start time, this aspect of the invention enables selecting and setting the time with the best reception environment as the reception start time, and can therefore further improve the probability of successful reception.

Further preferably in an electronic timepiece according to another aspect of the invention, the reception unit executes the reception process at the plural times for a specific period of time; the reception result storage unit stores the reception results for the specific period of time; and the reception time setting unit sets the next reception start time based on the reception results stored in the reception result storage unit during the specific period of time.

This specific period of time may be any period of plural days, such as one week (seven days).

Because the reception process is run at plural times during an initial specific period of time, the invention can get reception results based on the user's pattern of activity during that period of time. A period of time when the probability of successful reception is high can therefore be reliably determined, reception can be performed during a time when reception can succeed based on the user's pattern of activity, and the probability of successful reception is high.

An electronic timepiece according to another aspect of the invention preferably also has a manual reception unit that executes a manual reception process for receiving the satellite signals, and acquiring time information contained in the satellite signal when an external operating member is operated; the reception result storage unit stores a reception result of the manual reception process; and the reception time setting unit sets the reception start time based on the manual reception result stored in the reception result storage unit.

This aspect of the invention executes the manual reception process when the user operates an external operating member such as a button disposed to the electronic timepiece. The reception result storage unit then stores the reception result of the manual reception process. Because the reception time setting unit then sets the time when the manual reception process was run as the reception start time based on the result of the manual reception process, a time that the user determines suited to reception can be set as the reception start time.

As a result, because the invention can set the reception start time based on the result of a manual reception process when reception is started manually, in addition to setting the reception start time based on the result of other reception processes, the probability of successful reception can be further improved.

Another aspect of the invention is an electronic timepiece comprising: a reception unit that performs a reception process for receiving satellite signals sent from positioning satellites, and acquiring time information contained in the satellite signals; a manual reception unit that executes a manual reception process for receiving the satellite signals, and acquiring time information contained in the satellite signal when an external operating member is operated; a timekeeping unit that keeps time and adjusts the kept time based on the time information acquired by the reception unit; a reception result storage unit that stores the reception result of the manual reception process performed by the manual reception unit; and a reception time setting unit that sets a reception start time for starting the reception process based on the reception result stored in the reception result storage unit; wherein the reception unit executes the reception process when the time kept by the timekeeping unit matches the reception start time set by the reception time setting unit.

This aspect of the invention executes the manual reception process when the user operates an external operating member such as a button disposed to the electronic timepiece. The reception result storage unit then stores the reception result of the manual reception process. Because the reception time setting unit then sets the time when the manual reception process was run as the reception start time based on the result of the manual reception process, a time that the user determines suited to reception can be set as the reception start time. As a result, the probability of successful reception can be further improved.

In an electronic timepiece according to another aspect of the invention, the reception time setting unit sets a manual reception time at which the manual reception process succeeds as the reception start time.

When the reception start time is set based on a manual reception process, the reception start time can be set regardless of the result of the manual reception process (whether reception succeeds or fails). More specifically, that the user started the manual reception process can be taken to mean that the environment is suited to reception even if reception fails.

However, the user could also start the manual reception process accidentally. If the time of a manual reception process that was started accidentally is set as the reception start time, the possibility of reception failing increases.

Therefore, by setting the reception start time only when reception fails in the manual reception process, the probability of successful reception in the reception process is greater than if the reception start time is also set when the manual reception process fails.

Further preferably in an electronic timepiece according to another aspect of the invention, the reception time setting unit sets a manual reception time at which the manual reception process was performed as the reception start time when the manual reception process is performed a specific number of times within a previously set specific period of time.

A previously set specific period of time unit, for example, a range of +/−10 minutes of 8:00 in 24-hour time notation, and can be set as desired. For example, if the user starts manual reception at 8:00 Monday, 8:05 Tuesday, and 7:55 Wednesday, these three reception times are in the range of 8:00+/−10 minutes. In this case, the user can be determined to have started the manual reception process because the user's pattern of activity is outdoors in an environment suited to reception at approximately 8:00. The probability of succeeding at reception can therefore be improved by setting the next reception start time based on the time these manual reception processes were started.

The actual reception start time could be set, for example, to the time the manual reception process was started the first time, or to the average of plural reception times within a specific period of time.

Another aspect of the invention is a time adjustment method including steps of: executing a reception process that acquires time information contained in satellite signals sent from positioning satellites; keeping time; adjusting the time kept by the timekeeping step using the time information acquired in the reception process; storing a reception result of the reception process; and setting a reception start time at which the reception process starts based on the reception result stored by the storing step; wherein the step of executing the reception process executes the reception process when the time kept by the timekeeping step matches the reception start time.

This aspect of the invention has the same effect as the electronic timepiece described above.

Other objects and attainments together with a fuller understanding of the invention will become apparent and appreciated by referring to the following description and claims taken in conjunction with the accompanying drawings.

DESCRIPTION OF EMBODIMENTS

Embodiment 1

A first embodiment of the present invention is described below with reference to the accompanying figures.

Figure 1:
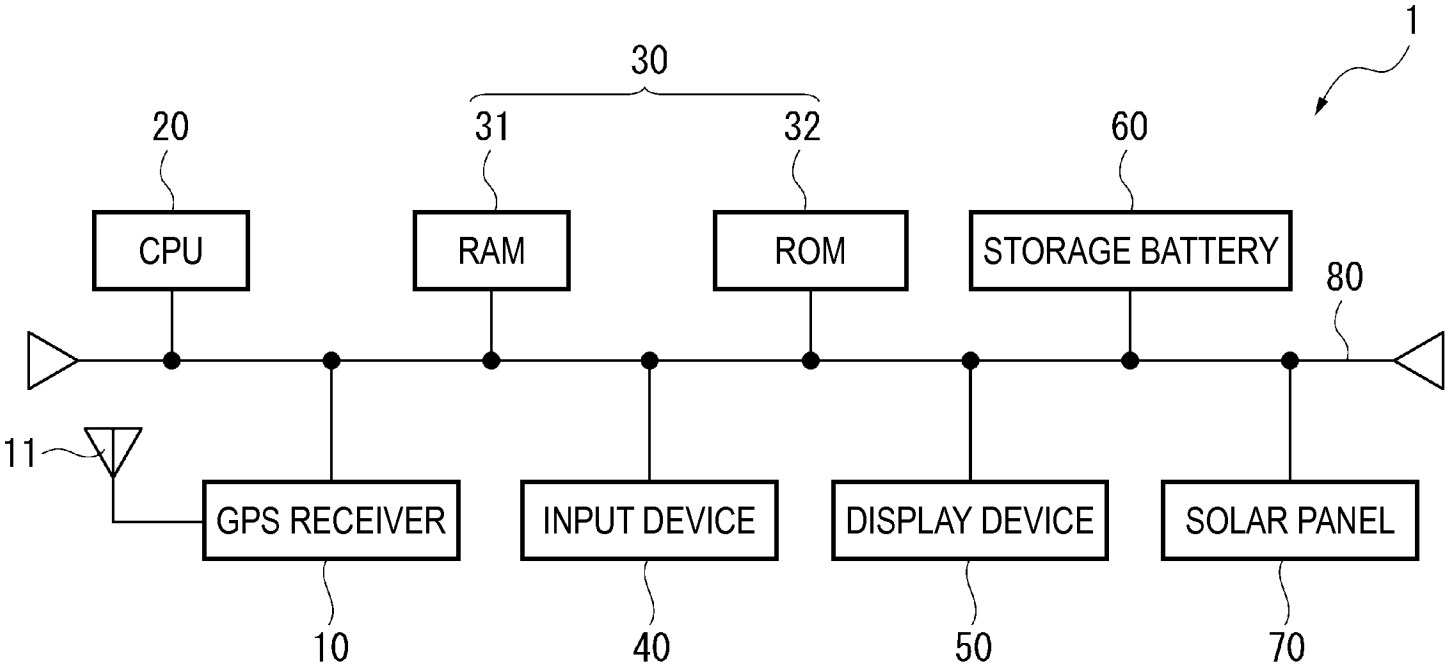
FIG. 1 is a block diagram showing the main circuit configuration of a GPS wristwatch as a preferred embodiment of an electronic timepiece according to the invention.

FIG. 1 schematically describes the main hardware configuration of a wristwatch with a GPS satellite signal receiver 1 (GPS wristwatch 1 below) as an example of an electronic timepiece according to the invention.

The GPS wristwatch 1 receives satellite signals and acquires satellite time information from a plurality of GPS satellites orbiting the Earth on known orbits, and uses the received information to correct internal time information and display the correct time.

Note that GPS satellites are one example of positioning satellites as used herein, and plural satellites are currently in orbit. More specifically, approximately 30 GPS satellites are currently in orbit.

Buttons and a crown are also disposed to the GPS wristwatch 1 as external operating members.

Circuits of a GPS Wristwatch

The basic circuit configuration of the GPS wristwatch 1 is described next.

As shown in FIG. 1, the GPS wristwatch 1 includes a GPS receiver 10 (GPS module), control unit (CPU) 20, memory device (memory unit) 30, input device 40, display device 50, storage battery 60, and solar panel 70. The memory unit 30 includes RAM 31 and ROM 32. These devices exchange data with each other over a data bus 80.

The display device 50 is composed of hands (second hand, minute hand, and hour hand) and a display for displaying the time and positioning information.

The storage battery 60 is a battery capable of storing power produced by a solar panel 70 as a generating device, and the storage battery 60 and solar panel 70 render a power supply that supplies power to the GPS wristwatch 1.

Configuration of a GPS Receiver

The GPS receiver 10 includes a GPS antenna 11, processes satellite signals received through the GPS antenna 11, and acquires time information and positioning information.

The GPS antenna 11 is, for example, a patch antenna that receives satellite signals from a plurality of GPS satellites on specific orbits around the Earth. This GPS antenna 11 is located on the back cover side of the dial, and is configured to receive signals that pass through the front crystal and dial of the GPS wristwatch 1.

As a result, the dial and the crystal are made of materials that easily pass RF signals such as the satellite signals transmitted from GPS satellites. For example, the dial is made of plastic.

Similarly to a common GPS receiver, and not shown in the figures, the GPS receiver 10 includes an RF (radio frequency) unit that receives and converts satellite signals sent from the GPS satellites to digital signals; a baseband unit that performs a correlation process to synchronize with the received signals; and an information acquisition unit that acquires time information and positioning information from the navigation message (satellite signal) demodulated by the baseband unit.

The RF unit includes a bandpass filter, PLL circuit, IF filter, VCO (voltage controlled oscillator), A/D converter, mixer, LNA (low noise amplifier), and IF amplifier.

Satellite signals extracted by the bandpass filter are amplified by the LNA and mixed with the VCO signal by the mixer, and then down-converted to an IF (intermediate frequency) signal. The IF signal mixed by the mixer passes through an IF amplifier and IF filter, and is converted to a digital signal by the A/D converter.

The baseband unit includes a local code generator and a correlation unit. The local code generator generates a local code that is identical to the C/A code used by the GPS satellite for signal transmission. The correlation unit calculates the correlation between this local code and the reception signal output from the RF unit.

If the correlation value calculated by the correlation unit is greater than or equal to a specific threshold value, the local code matches the C/A code used in the received satellite signal, and locking onto (synchronization with) the satellite signal is possible. As a result, the navigation message can be demodulated by applying a correlation process to the received satellite signal using the local code.

The data acquisition unit acquires the time information and positioning information from the navigation message demodulated by the baseband unit. More specifically, the navigation messages sent from the GPS satellites include preamble data and the TOW (Time of Week, also called the Z count) of the HOW (Handover Word), and subframe data. The subframe data includes subframes 1 to 5, and each subframe contains, for example, satellite correction data such as the week number and satellite health data, ephemeris (detailed orbit information for a particular GPS satellite), and almanac data (orbit information for all GPS satellites).

The data acquisition unit extracts specific data from the received navigation message, and acquires the time information and positioning information. A reception unit is therefore rendered by a GPS receiver 10 in this embodiment of the invention.

A program run by the control unit 20 is stored in ROM 32 in the memory unit 30.

The satellite signal acquired by the reception process, the time information and reception result described below, and the location information calculated by a positioning operation when signals are received in the positioning mode, are stored in RAM 31 in the memory unit 30.

Figure 2:
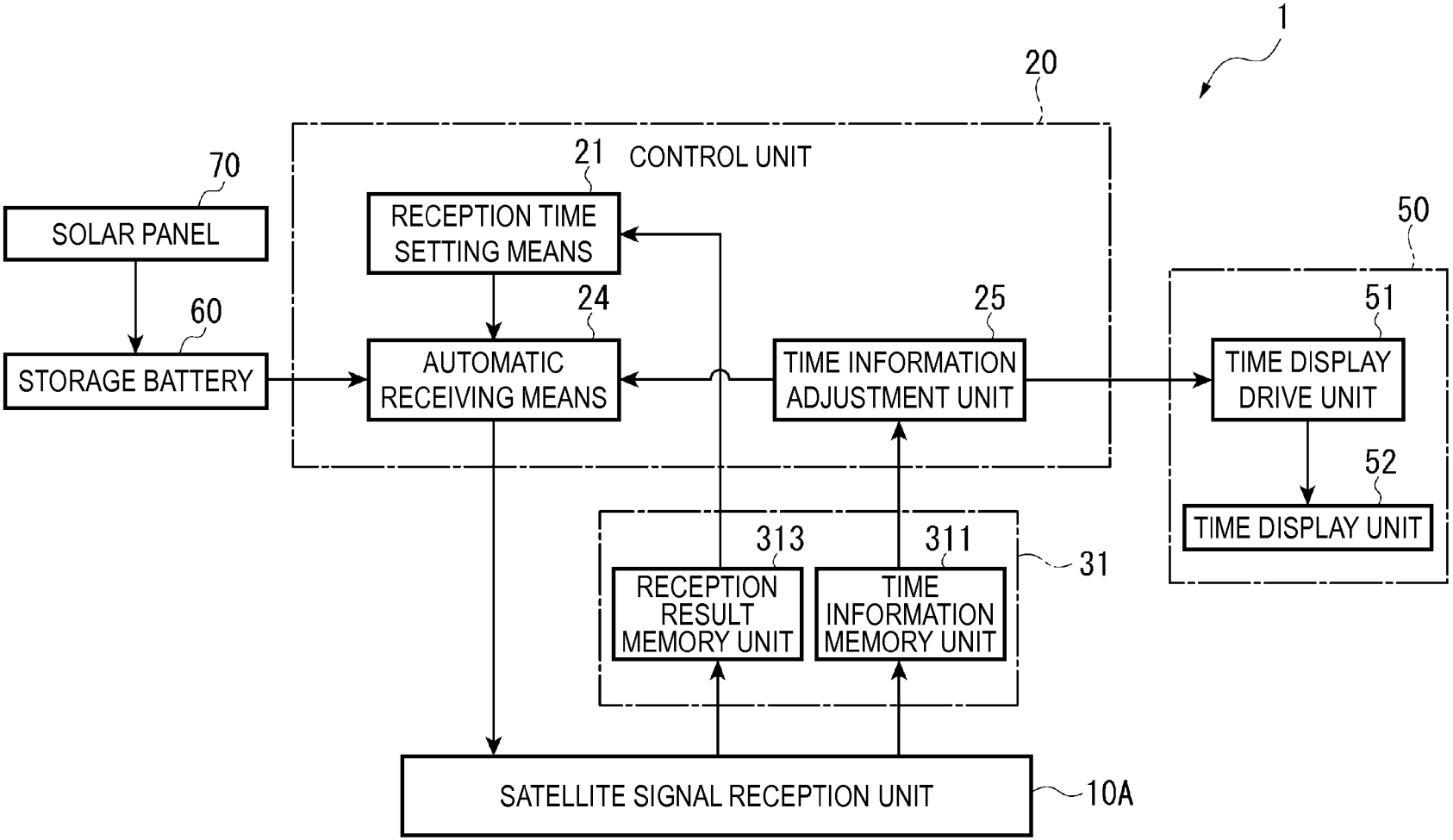
FIG. 2 is a block diagram showing the main system configuration of the GPS wristwatch shown in FIG. 1.

As shown in FIG. 2, therefore, RAM 31 includes a time information memory unit 311 that stores the time information acquired from received signals, and a reception result memory unit 313 that stores the reception result.

FIG. 2 is a block diagram showing the system configuration of the GPS wristwatch 1 according to this embodiment of the invention.

The control unit 20 (CPU) controls the satellite signal reception unit 10A of the GPS receiver 10, and corrects the local time information based on the acquired time information.

The control unit 20 controls operation based on a program stored in ROM 32. The control unit 20 therefore includes a reception time setting unit 21, automatic receiving unit 24, and time information adjustment unit 25.

The reception time setting unit 21 sets the time when the automatic receiving unit 24 starts the reception process. A specific example of the method of setting the reception start time is described below.

The automatic receiving unit 24 controls executing the reception process when the internal clock kept by the time information adjustment unit 25 described below reaches the reception start time set by the reception time setting unit 21. More specifically, when the set reception start time arrives, the automatic receiving unit 24 controls the satellite signal reception unit 10A of the GPS receiver 10 to execute the reception process. A reception unit of the invention is thus embodied by this automatic receiving unit 24. Note that below the automatic reception start time unit the reception start time set by the reception time setting unit 21, and the automatic reception process unit the reception process performed by the automatic receiving unit 24.

Note that the automatic receiving unit 24 could run the automatic reception process with further consideration for the current storage battery 60 voltage. More specifically, the automatic reception process could be skipped if the storage battery 60 voltage is less than a specific threshold (such as 3.6 V) when the reception start time arrives.

For example, the automatic receiving unit 24 could detect the remaining battery capacity of the storage battery 60, determine if the battery voltage is greater than or equal to the specific threshold, and perform the automatic reception process only if the battery voltage is greater than or equal to the specific threshold. If the reception process is performed when the remaining battery voltage is low, power consumption from reception could cause a sudden drop in the battery voltage and cause a system shutdown. A system shutdown can therefore be prevented by applying control so that the reception process is not performed when the battery voltage is less than the threshold.

The satellite signal reception unit 10A runs the reception process and acquires the time information. The time information received by the satellite signal reception unit 10A is stored in the time information memory unit 311 in RAM 31.

The reception result of the satellite signal reception unit 10A, and more specifically reception result information indicating if reception was successful or not, and the time the reception process started, are stored in the reception result memory unit 313 in RAM 31.

The time information adjustment unit 25 controls the display device 50, which includes a time display drive unit 51 and time display unit 52. The time display unit 52 has hands, and the time display drive unit 51 is a motor or other unit of driving the hands.

The time information adjustment unit 25 adjusts the time of the internal clock based on time information stored in the time information memory unit 311 and the time zone of the current location. This time zone information may be manually set by the user, or by receiving satellite signals, acquiring the current location by applying a positioning process to the received signals, and reading a time zone table that stores time zone information for the current location in RAM 31.

The time information adjustment unit 25 keeps the internal time based on a reference signal from an oscillation circuit not shown, and regularly updates the time displayed by the time display unit 52 through the time display drive unit 51. A timekeeping unit of the invention is therefore also embodied by the time information adjustment unit 25.

Note that if the time display drive unit 51 uses a display as the time display unit 52, a circuit for driving the display is also provided.

Reception Time Setting Unit

The method of setting the automatic reception start time in the reception time setting unit 21 is described next.

The reception time setting unit 21 sets 8:00, for example, as the default automatic reception start time. If reception at this automatic reception start time is successful, the automatic reception start time is not changed and is kept the same.

If reception fails at the set automatic reception start time, the reception time setting unit 21 changes the automatic reception start time to a specific preset time later (one hour later in this embodiment).

If reception is successful at the updated automatic reception start time, the updated automatic reception start time is kept and continues to be used.

The reception time setting unit 21 thus sets the reception start time when reception succeeds as the automatic reception start time.

Automatic Reception Process

Control of the automatic reception process by the control unit 20 is described next with reference to the flow chart in FIG. 3.

The automatic receiving unit 24 first reads the internal time kept by the time information adjustment unit 25, and determines if the current time is the automatic reception time set by the reception time setting unit 21 (S1). If S1 returns No, decision step S1 repeats until the automatic reception time comes.

When the automatic reception time comes and S1 returns Yes, the automatic receiving unit 24 drives the satellite signal reception unit 10A and starts reception (S2).

As a result of the reception process performed by the satellite signal reception unit 10A, the automatic receiving unit 24 determines if time information was successfully received (S3). Note that reception is successful when the satellite signal is received and time information acquired, and reception is determined to have failed otherwise, such as when a GPS satellite could not be found and a signal was not received, or when a satellite signal was received but the time information could not be acquired.

When the Automatic Reception Process is Successful

If S3 returns Yes and reception was successful, the satellite signal reception unit 10A stores the acquired time information in the time information memory unit 311, and stores reception result information indicating reception was successful, and the reception start time of the successful reception process, in the reception result memory unit 313 (S4).

The time information adjustment unit 25 then runs a time adjustment process using the time information stored in the time information memory unit 311 (S5).

When the automatic reception process succeeds, the reception time setting unit 21 does not change the automatic reception start time and keeps the same time.

The automatic receiving unit 24 then returns to the decision step of S1. As a result, the reception process is not repeated until the same time the next day (such as 8:00 in this example), and the automatic reception process S2 starts at the same time.

When the Automatic Reception Process Fails

If reception failed and S3 returns No, the satellite signal reception unit 10A does not store time information to the time information memory unit 311 because the time information could not be acquired. The satellite signal reception unit 10A then stores reception result information indicating that reception failed, and the time the failed reception process started, in the reception result memory unit 313 (S6).

The reception time setting unit 21 then changes the automatic reception start time to a preset specific later time (one hour later) (S7).

The automatic receiving unit 24 then returns to decision step S1. As a result, the reception process is not performed until one hour after (9:00) the previous automatic reception process (at 8:00, for example), and the automatic reception process starts (S2) when the updated time arrives.

If reception is successful in the reception process performed at the updated automatic reception start time (S3 returns Yes), the time information and reception result storing step (S4) and time adjustment step (S5) are performed.

However, if reception fails in the reception process performed at the updated automatic reception start time (S3 returns No), the reception result storing step (S6) and automatic reception start time updating step (S7) are performed.

By repeating steps S1 to S7, the reception process is performed once an hour until reception is successful in the automatic reception process performed at the set automatic reception start time, the time when reception succeeds is set as the automatic reception start time, and the automatic reception process is performed the next day at the new automatic reception start time.

Effect of Embodiment 1

This first embodiment of the invention sets the time when the automatic reception process starts to the time that reception succeeded in the previous automatic reception process based on the reception result stored in the reception result memory unit 313. As a result, the period of time when reception was successful in the past is automatically set as the automatic reception start time, the automatic reception process can be performed at a time when reception is easy based on the user's daily pattern of activity, and the probability of successful reception is improved.

More specifically, in order to successfully receive satellite signals during the automatic reception process, the GPS wristwatch 1 is preferably outdoors or in a similar environment suited to receiving satellite signals. For example, if the user wearing the GPS wristwatch 1 works in an office building, or is travelling at high speed in a train or car and moving frequently and constantly in and out of stations or the shadow of buildings, the possibility that reception will fail is high.

However, the possibility that reception will succeed is high if the user is outdoors with a clear view of the sky. The possibility that reception will succeed is therefore relatively high while walking from home to the station, or walking from the station to work, for example.

The period of time when reception is easy also changes according to the user's pattern of daily activity. This embodiment automatically sets the time when reception succeeded in the last automatic reception process as the automatic reception start time. More specifically, the probability that reception will succeed in the automatic reception process is increased by adjusting the reception time based on whether reception succeeded or failed, and performing the reception process at the time of the last successful reception according to the user's pattern of activity. The probability that reception will succeed during automatic reception and the time information can be acquired is improved, the correct time can be displayed on the time display unit 52, wasteful reception processes can be prevented and power consumption reduced, and system shutdowns can be prevented.

If reception fails at the automatic reception start time, the automatic receiving unit 24 performs the reception process again after a specific time, and sets the time when reception succeeds as the new automatic reception start time. As a result, the probability that reception will succeed can be further improved even when the user's pattern of activity changes because the reception process can be performed based on the most recent pattern of activity.

Furthermore, because the information used by the automatic receiving unit 24 in the automatic reception process is only time information, a separate special sensor for acquiring information to evaluate the reception conditions is not required, increased power consumption can be prevented, and the invention can be easily used in small electronic timepieces such as wristwatches.

Embodiment 2

A second embodiment of the invention is described next.

This second embodiment differs from the first embodiment in that the automatic reception start time is set based on the reception results over a certain period of time. The configuration of the GPS wristwatch 1 is therefore the same as in the first embodiment, and further description thereof is omitted.

Figure 3:
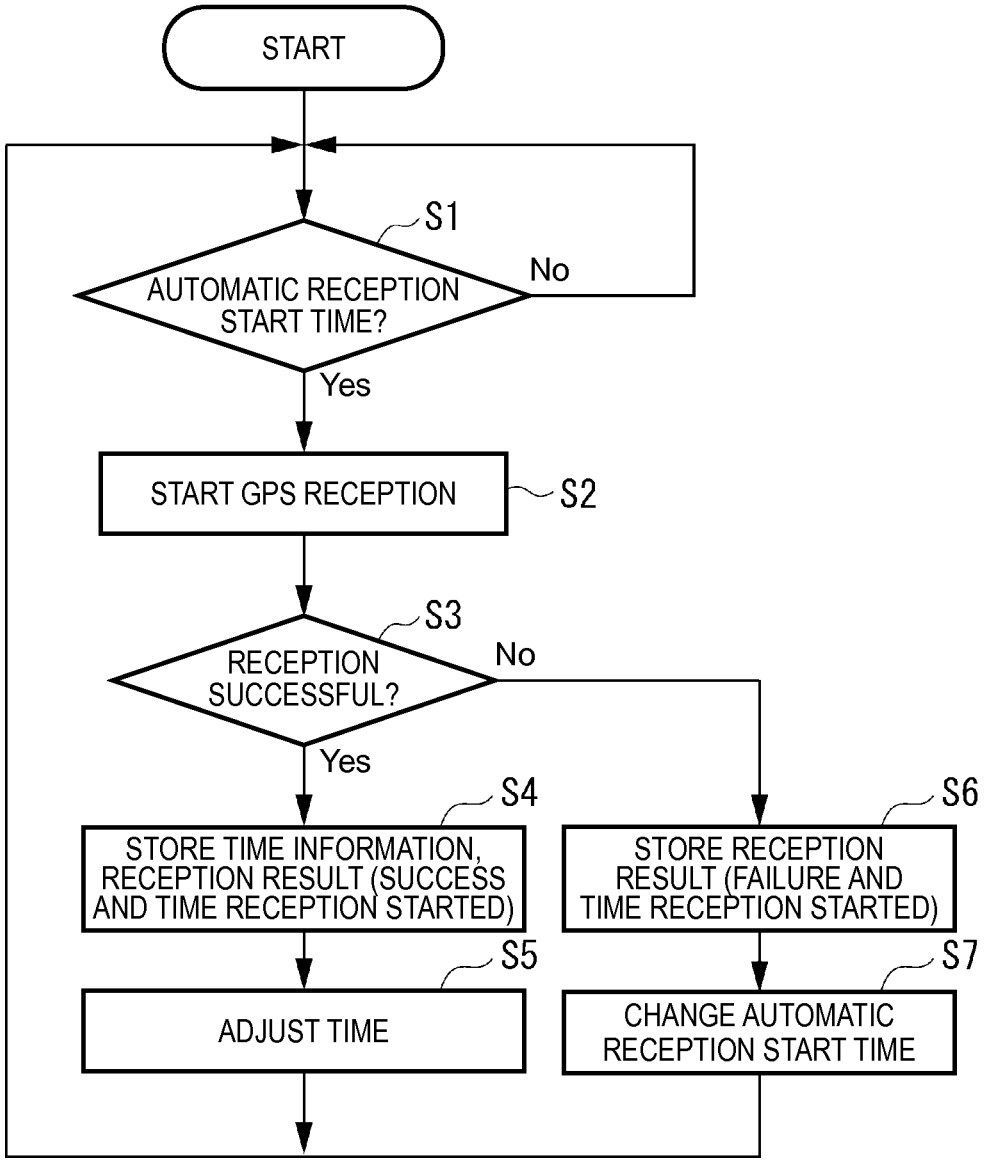
FIG. 3 is a flow chart of the reception process in a first embodiment of the invention.
Figure 4:
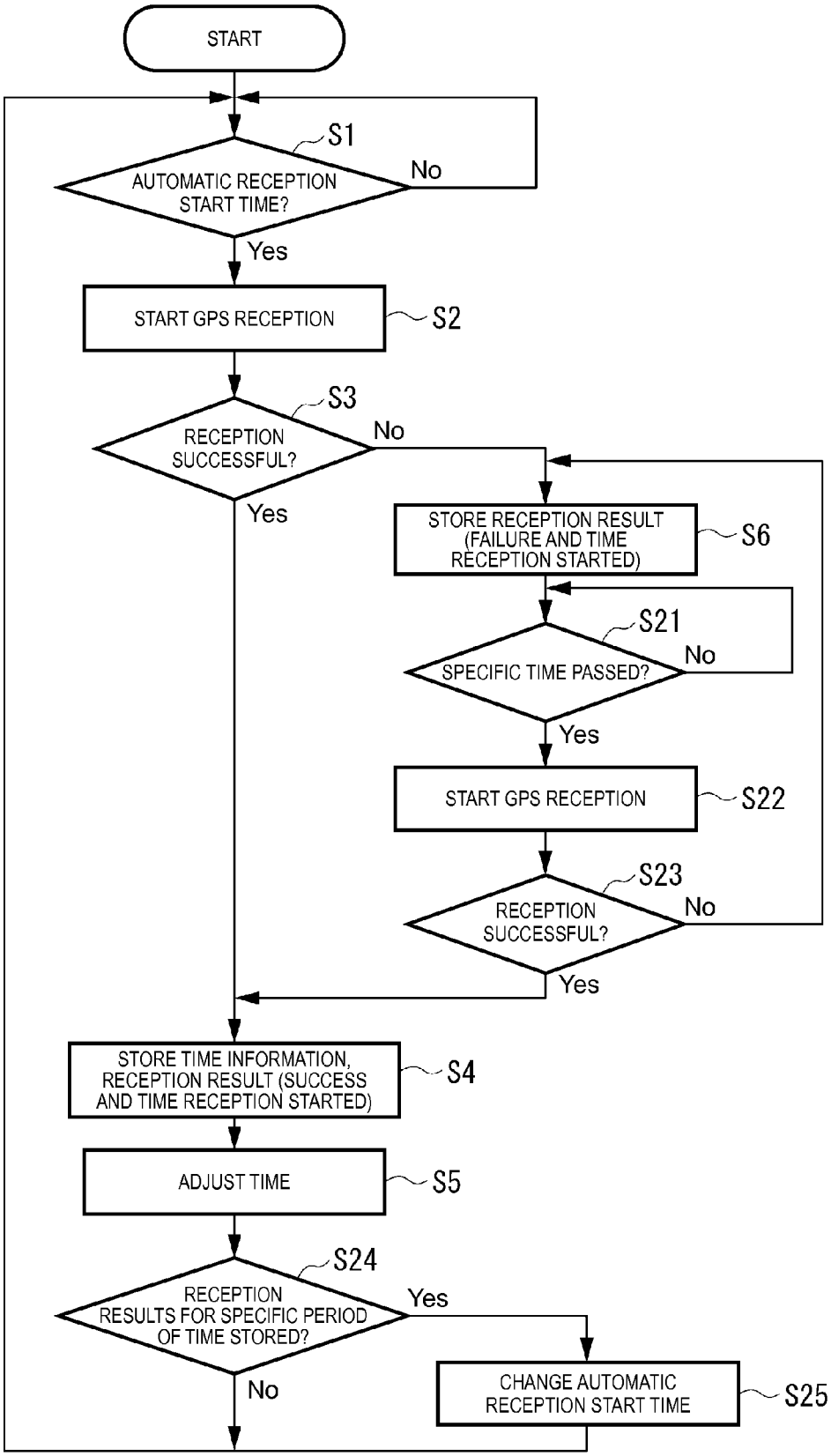
FIG. 4 is a flow chart of the reception process in a second embodiment of the invention.

Identical steps in the process of the second embodiment shown in FIG. 4 and the process of the first embodiment shown in FIG. 3 are identified by the same reference numerals, and further description thereof is omitted.

Steps S1 to S3 in this second embodiment are the same as in the first embodiment, and when step S3 determines reception was successful, steps S4 and S5 execute as in the first embodiment.

When step S3 determines reception failed, step S6 is also the same as in the first embodiment.

After step S6, the automatic receiving unit 24 determines if a specific time has passed (S21), and starts the reception process if the specific time passed (S22). The specific time used in S21 is set to one hour, for example.

The result of the reception process in S22 is then determined (S23), and S4 and S5 are performed if reception is successful. More specifically, the reception start time of the successful reception process is stored in the reception result memory unit 313 in S4.

If S23 determines reception failed, the automatic receiving unit 24 repeats steps S6 to S23.

After S5, the reception time setting unit 21 determines if the reception results for a specific period of time have been recorded (S24). This period of time is a preset period of two days or more, for example, and in this embodiment of the invention is the most recent week (7 days).

If S24 determines that reception results for the specific period of time have not been recorded, such as when a week has not passed since the GPS wristwatch 1 was turned on, S24 returns No, operation returns to S1, and the process continues. Because in this case the automatic reception start time is set to the default time (such as 8:00), the reception process starts in S2 when the default time (8:00) comes again.

However, if S24 returns Yes, the reception time setting unit 21 changes the automatic reception start time based on the reception results from the specific period of time (S25). The reception time setting unit 21 sets the automatic reception start time to the starting time at which the frequency of successful reception is highest in the reception results for the one week period. More specifically, if reception is successful in this one week period twice at 8:00, four times at 9:00, and once at 17:00, 9:00, the time at which reception was most frequently successful, is set as the new automatic reception start time.

When new successful reception results are recorded each day thereafter, the reception time setting unit 21 sets the new automatic reception start time based on the frequency of the successful reception times in the most recent specific period of time, that is, 7 days.

Effect of Embodiment 2

This second embodiment has the same effect as the first embodiment described above.

In addition, because the automatic reception start time is set based on the reception results during a specific period of time, a reception time appropriate to the user's normal pattern of activity can be set.

For example, because the first embodiment sets the time when the reception process succeeds one day as the new automatic reception start time, the automatic reception start time set based on the result of reception on a day when the user's pattern of activity differed from normal may not be appropriate for the automatic reception process the next day.

However, because this embodiment sets the most appropriate automatic reception start time based on the reception results from a one week period, a time that is more appropriate based on the user's pattern of activity can be set, and the probability of successful reception can be improved.

Embodiment 3

Figure 5:
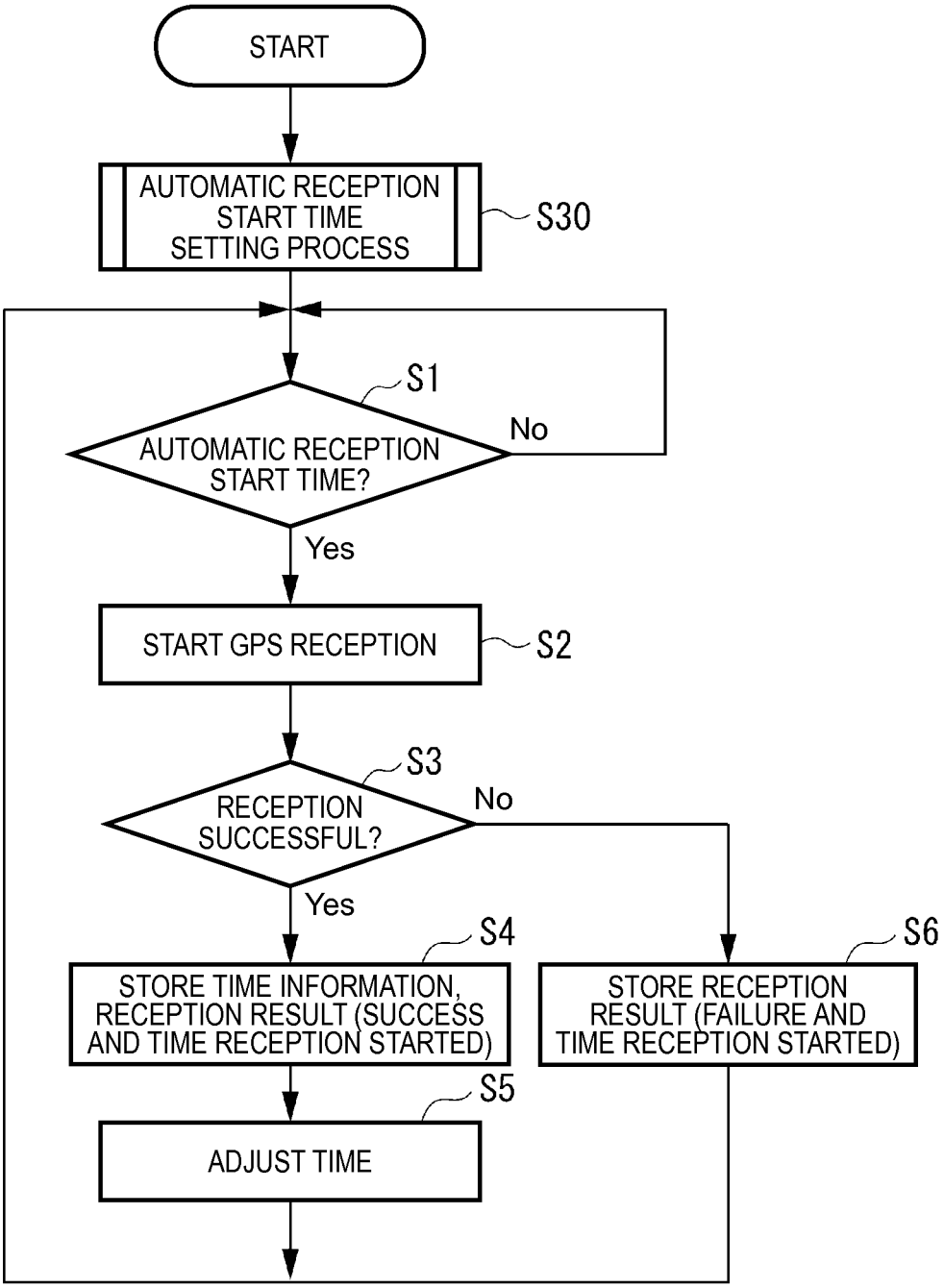
FIG. 5 is a flow chart of the reception process in a third embodiment of the invention.
Figure 6:
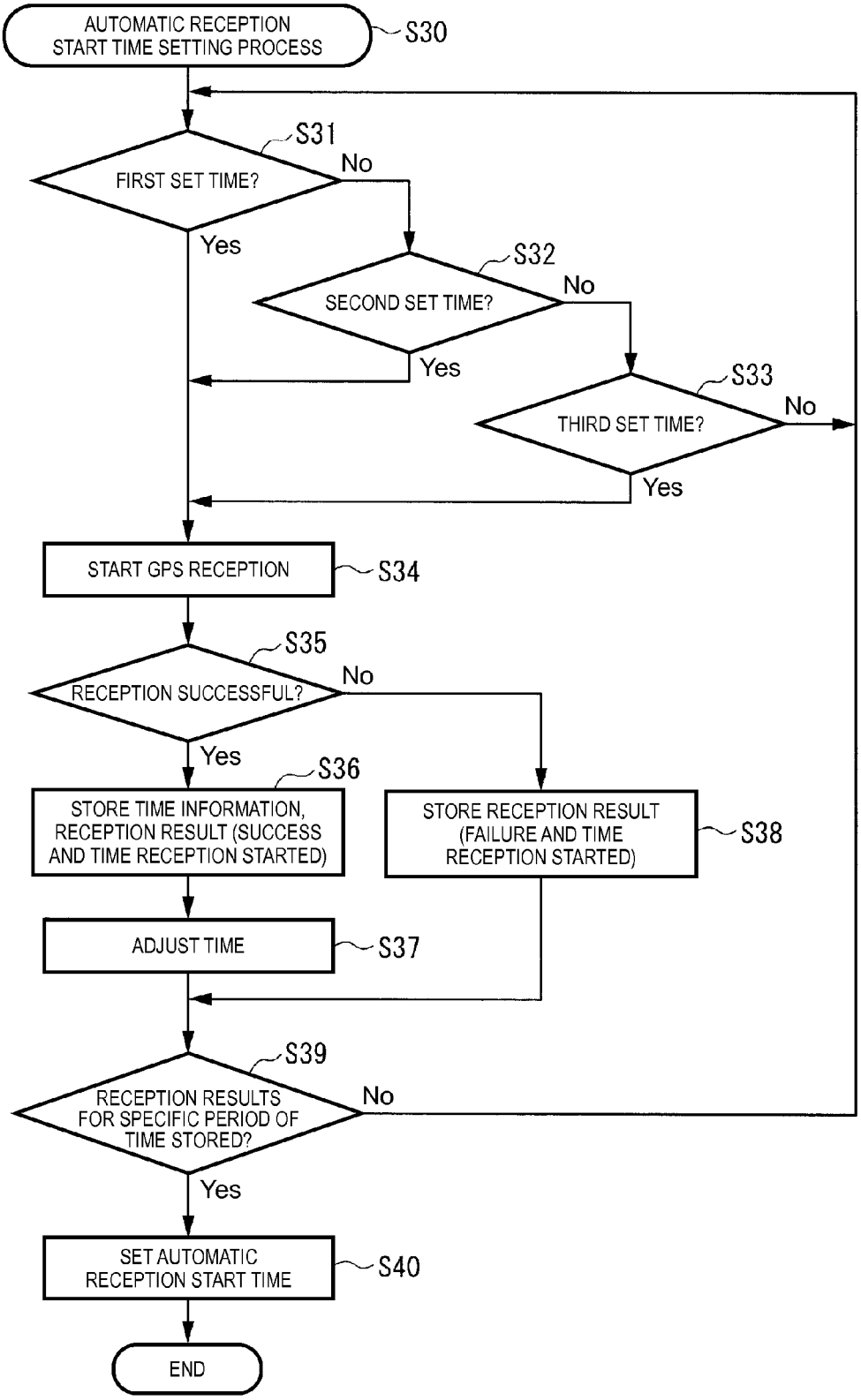
FIG. 6 is a flowchart of the process of setting the automatic reception start time in the third embodiment of the invention.

The third embodiment differs from the preceding embodiments by performing the process of setting the automatic reception start time first as shown in FIG. 5 and FIG. 6. The configuration of the GPS wristwatch 1 is therefore the same as in the first embodiment, and further description thereof is omitted.

Identical steps in the process of the third embodiment shown in FIG. 5 and FIG. 6 and the processes of the foregoing embodiments are identified by the same reference numerals, and further description thereof is omitted.

As shown in FIG. 5, the GPS wristwatch 1 according to the third embodiment of the invention performs the process setting the automatic reception start time first (S30). This automatic reception start time setting process S30 is executed immediately after a GPS wristwatch 1 in which the automatic reception start time is not set is used for the first time, and when the setting is initialized by the user.

When the automatic reception start time setting process S30 is executed, the automatic receiving unit 24 determines if the previously set time has come. Three times are set in this embodiment. In this example the first set time is 8:00, the second set time is 18:00, and the third set time is 23:00.

Note that the number of set times and the specific times set are not limited to those in this example. Three or four time settings are normally sufficient. Power consumption increases as the number of time settings increases, but the time can be set more precisely according to the user's pattern of activity. Specific time settings can also be initialized as factory settings, or manually by the user.

The automatic receiving unit 24 determines if the time kept by the time information adjustment unit 25 is the first set time (S31); if not, determines if the time is the second set time (S32); and if not, determines if the time is the third set time (S33).

If S33 returns No, control returns to S31 and the process continues.

If Yes is returned by any of S31 to S33, the automatic receiving unit 24 operates the satellite signal reception unit 10A and starts reception (S34), and then determines if reception was successful (S35).

If S35 returns Yes, the satellite signal reception unit 10A stores the acquired time information in the time information memory unit 311, and stores reception result information indicating reception was successful, and the reception start time of the successful reception process, in the reception result memory unit 313 (S36).

The time information adjustment unit 25 then runs the time adjustment process using the time information stored in the time information memory unit 311 (S37).

If S35 returns No, the satellite signal reception unit 10A stores the acquired time information in the time information memory unit 311, and stores reception result information indicating reception failed, and the reception start time of the failed reception process, in the reception result memory unit 313 (S38).

After S37 and S38 the reception time setting unit 21 determines if the reception results for a specific period of time have been recorded (S39). This period of time is a preset period of two days or more, for example, and in this embodiment of the invention is the most recent week (7 days).

If S39 determines that reception results for the specific period of time have not been recorded, such as when a week has not passed since the GPS wristwatch 1 was turned on, S39 returns No, operation returns to S31, and the process continues. As a result, the reception process is executed everyday at the first to third set times for one week.

However, if S39 returns Yes, the reception time setting unit 21 changes the automatic reception start time based on the reception results from the specific period of time (S40). The reception time setting unit 21 sets the automatic reception start time to the first to third set time that had the highest frequency of successful reception in the reception results for the one week period. If the frequency of successful reception is the same at plural set times, the time best suited to reception can be selected based on, for example, the set time with the highest average signal reception level.

This completes the automatic reception start time setting process S30.

Thereafter, as in the embodiments described above, whether the current time is the automatic reception start time set by the process in S30 is determined (S1), the reception process starts at that time (S2), and whether reception was successful is determined (S3) as shown in FIG. 5.

If reception succeeded, the time information and reception result are stored (S4), the time is adjusted (S5), and control returns to step S1.

If reception fails, the reception result is stored (S6), and control returns to S1.

Effect of Embodiment 3

This third embodiment has the same effect as the embodiments described above.

In addition, because the automatic reception start time setting process is performed in S30, an automatic reception start time that is optimal based on the user's normal pattern of activity during the initial specific period of time can be set. As a result, the probability of successful reception can be further improved.

Embodiment 4

Figure 7:
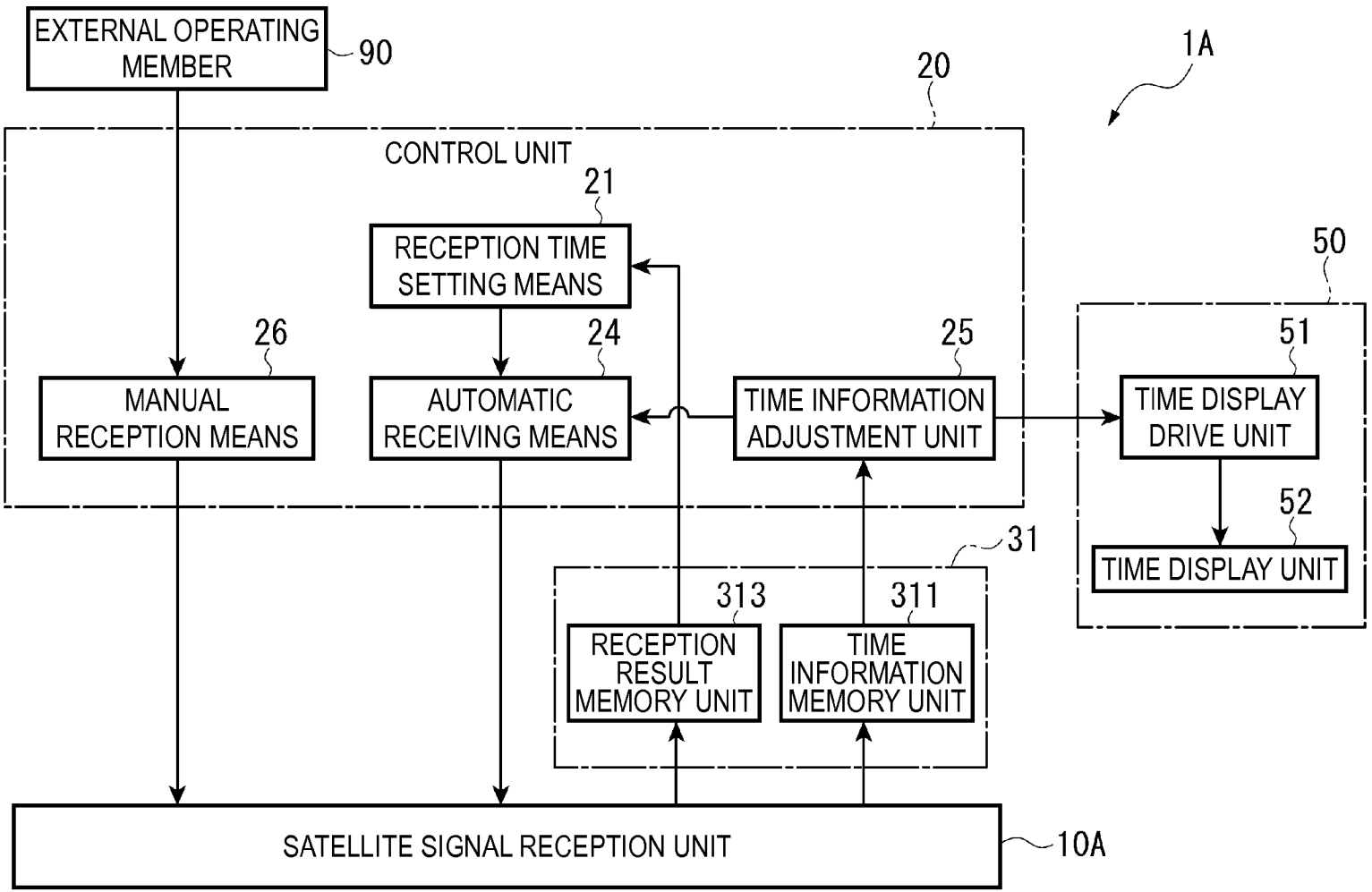
FIG. 7 is a block diagram showing the main system configuration of a fourth embodiment of the invention.
Figure 8:
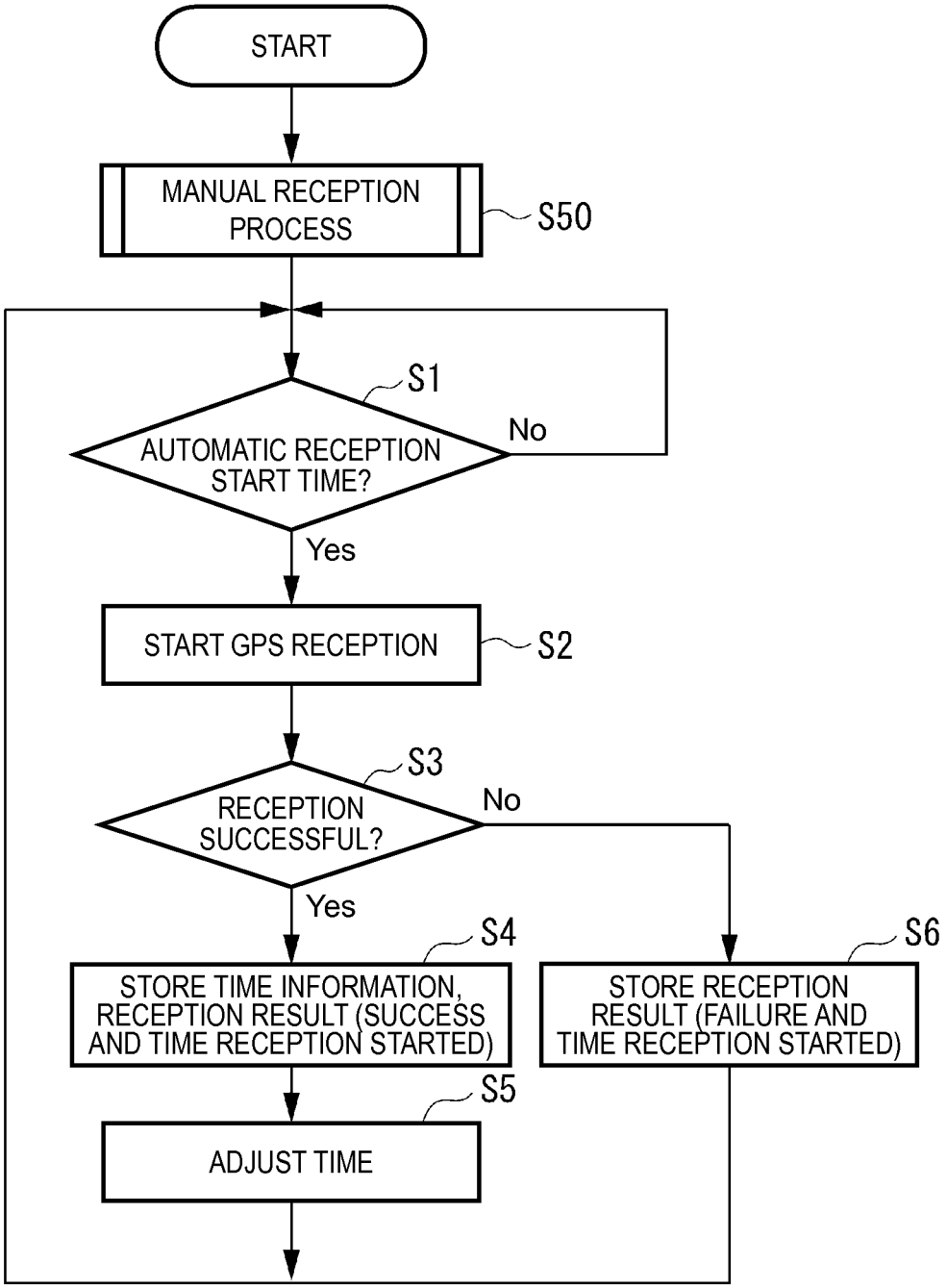
FIG. 8 is a flow chart of the reception process in a fourth embodiment of the invention.
Figure 9:
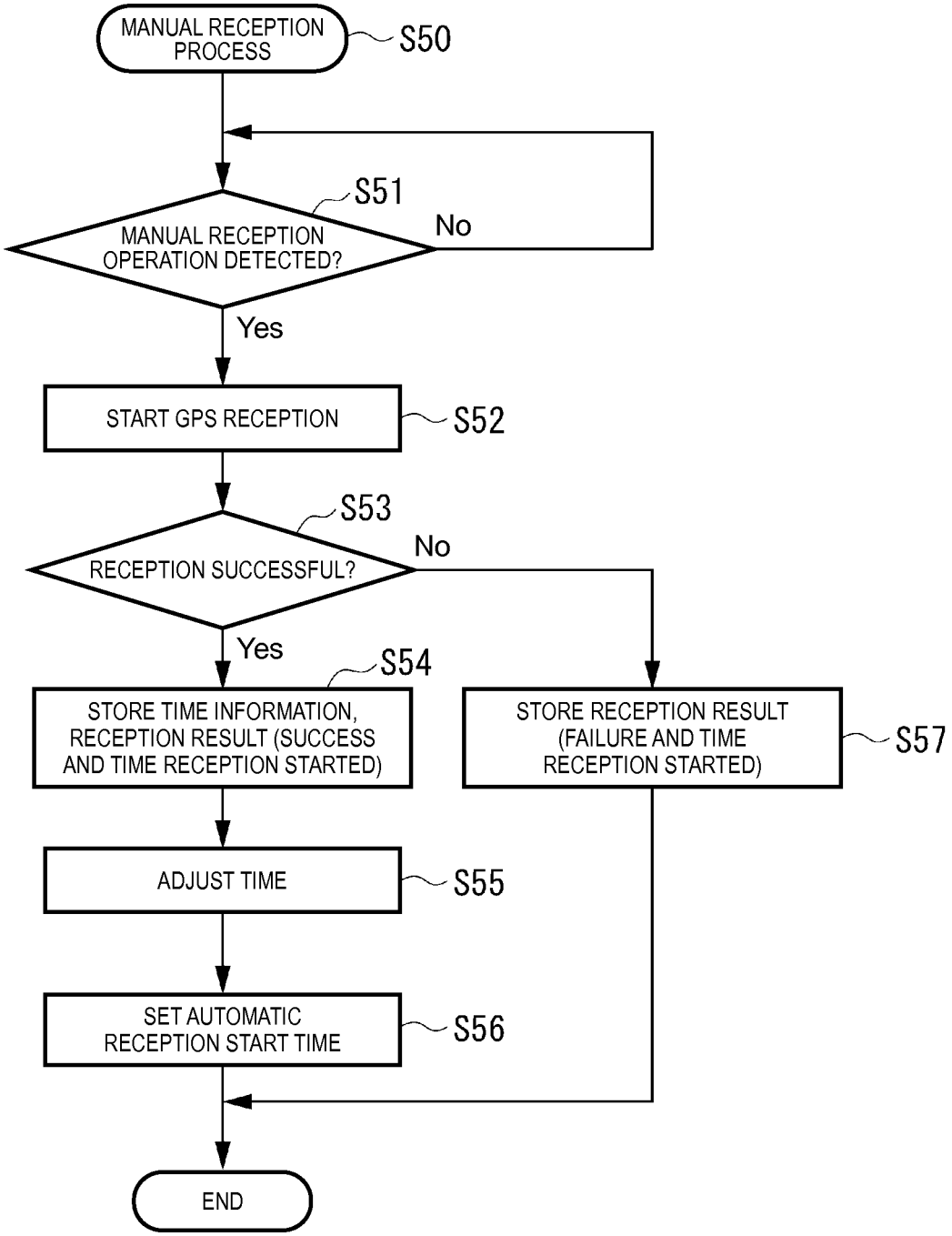
FIG. 9 is a flow chart of the manual reception process in a fourth embodiment of the invention.

The fourth embodiment differs from the preceding embodiments by performing the process of setting the automatic reception start time based on the result of a manual reception process as shown in FIG. 7 to FIG. 9. The configuration of this embodiment is therefore the same as in the foregoing embodiments, and further description thereof is omitted.

As shown in FIG. 7, the GPS wristwatch 1A according to this embodiment of the invention adds an external operating member 90 such as a button for starting the reception process, and a manual reception unit 26 that executes the reception process after operation of the external operating member 90 is detected, to the configuration of the GPS wristwatch 1 described above.

The reception result of the manual reception process is also stored in the reception result memory unit 313.

The process performed when the manual reception operation is received in this embodiment is described next with reference to the flow charts in FIG. 8 and FIG. 9.

As shown in FIG. 8, the control unit 20 executes the manual reception process (S50). In the manual reception process, as shown in FIG. 9, the manual reception unit 26 determines if the manual reception process was started by the button or other external operating member 90 (S51). If S51 returns No, the detection step S51 continues.

If reception was manually started by the user and S51 returns yes, the manual reception unit 26 operates the satellite signal reception unit 10A and runs the satellite signal reception process (S52), and determines if reception was successful (S53).

If S53 returns Yes, the satellite signal reception unit 10A stores the acquired time information in the time information memory unit 311, and stores reception result information indicating reception was successful, and the reception start time of the successful reception process, in the reception result memory unit 313 (S54).

The time information adjustment unit 25 then runs a time adjustment process using the time information stored in the time information memory unit 311 (S55).

The reception time setting unit 21 then sets the reception start time when reception was started manually and was successful as the automatic reception start time (S56).

If S53 returns No, the satellite signal reception unit 10A stores reception result information indicating that reception failed, and the reception start time of the failed reception process, in the reception result memory unit 313 (S57). Processing a manual reception operation then ends.

When the manual reception process S50 ends, as shown in FIG. 8, the automatic receiving unit 24 determines if the automatic reception start time set by the process in S50 has come (S1), starts the reception process if the time has come (S2), and then determines if reception was successful (S3).

If reception succeeded, the time information and reception result are stored (S4), the time is adjusted (S5), and control returns to step S1.

If reception fails, the reception result is stored (S6), and control returns to S1.

Effect of Embodiment 4

This fourth embodiment has the same effect as the embodiments described above.

In addition, because the time of successful reception in the manual reception process S50 is set as the automatic reception start time, the user can set an automatic reception start time that is suited to reception during the user's pattern of activity. The optimal automatic reception start time can therefore be set and the probability of successful reception can be further improved.

Embodiment 5

Figure 10:
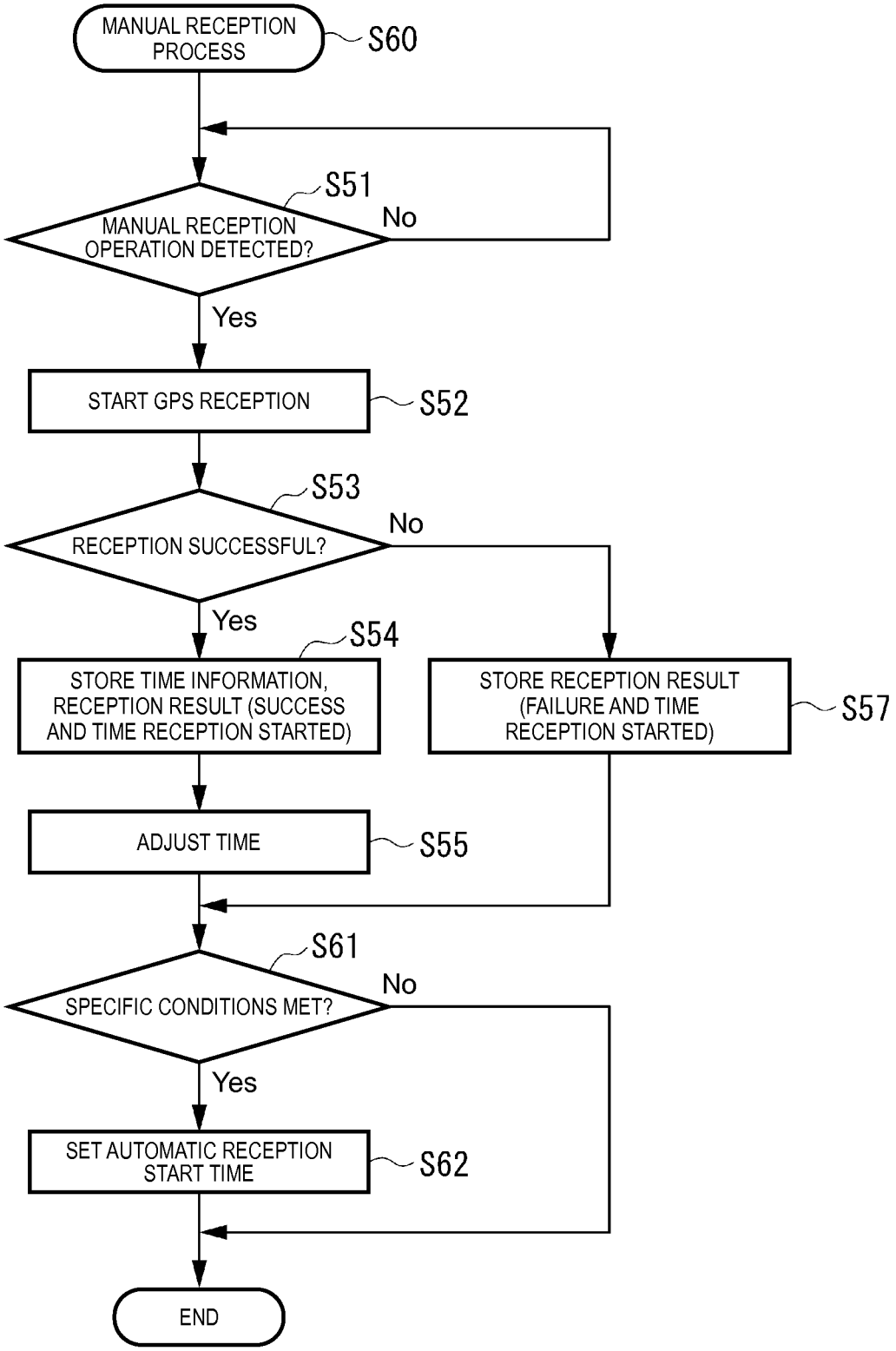
FIG. 10 is a flow chart of the manual reception process in a fifth embodiment of the invention.

The fifth embodiment of the invention differs from the fourth embodiment by executing the manual reception process S60 shown in FIG. 10 instead of the manual reception process S50 of the fourth embodiment. Other aspects of the configuration and operation of this embodiment are the same as the fourth embodiment, and further description thereof is omitted.

As shown in FIG. 10, steps S51 to S55, and S57 in the manual reception process S60 according to the fifth embodiment of the invention are the same as in the fourth embodiment.

When steps S54 and S55 are executed because reception succeeded, and when S57 is executed because reception failed, the reception time setting unit 21 determines if specific conditions for setting the automatic reception start time are met (S61).

Examples of these specific conditions in S61 are described below. Step S61, for example, determines if the manual reception process was performed a specific number of times or more, and if the time of manual reception is within a specific period of time.

Whether the manual reception time is within a specific period of time unit, for example, a range of +/−10 minutes of the first manual reception time. More specifically, if the specific number of times is set to 3, and the manual reception process is started at 8:00 Monday, 8:05 Tuesday, and 7:55 Wednesday, this specific condition is met because the three manual reception times (the time manual reception started) are in the range 8:00 +/−10 minutes. Note that the number and times of the manual reception processes are determined when reception fails in addition to when reception succeeds in this embodiment, but evaluation may be based only on when reception succeeds.

If this condition is met, the reception time setting unit 21 sets the automatic reception start time (S62). Specifically, the reception time setting unit 21 sets the first manual reception time (8:00 in this example), or the average of the three reception start times, as the automatic reception start time.

The automatic reception process after the automatic reception start time is set is identical to steps S1 to S6 in FIG. 8 according to the fourth embodiment, and further description thereof is omitted.

Effect of Embodiment 5

This fifth embodiment has the same effect as the embodiments described above.

In addition, because when a plurality of manual reception processes are executed within a specific period of time in manual reception process S50 that time is set as the automatic reception start time, the automatic reception start time is not set when the user mistakenly starts the manual reception process once, and the automatic reception start time can be set only when the user starts the manual reception process plural times during the same period of time. As a result, the user can set the automatic reception start time to a period of time that is suited to reception according to the user's own pattern of activity. The optimal automatic reception start time can therefore be set and the probability of successful reception can be further improved.

Other Embodiments

The invention is not limited to the embodiments described above.

For example, the third embodiment sets the automatic reception start time after performing the automatic reception process at first to third set times for a specific period of time (one week), but the automatic reception start time could be set after the automatic reception process is performed at the first to third set times for one day, that is, once each. This has the advantage of being able to quickly set the automatic reception start time. If reception is successful at each of the plural set times, the time best suited to reception can be selected based on, for example, the time with the highest signal reception level.

Each of the foregoing embodiments also stores the reception result in the reception result memory unit 313 when reception fails, but the reception results could be stored in the reception result memory unit 313 only when reception succeeds without storing the reception results when reception fails in the reception result memory unit 313. More specifically, when the automatic reception start time is set based on the time when reception succeeds, there is no need to store the reception results when reception fails.

However, by also storing the reception results when reception fails, the automatic reception start time can be set to a time separated a specific time or more from the time when reception failed. For example, if the time when reception succeeds and the time when reception fails are within 30 minutes of each other, reception may have succeeded accidentally. The reception failure result may therefore be referenced so that the automatic reception start time is not set within a specific range of when reception failed.

When reception results are stored for a specific period of time (such as one week) as in the second and third embodiments, the automatic reception start time could be set according to the day of the week based on the reception results for each day. This enables setting an automatic reception start time suitable for reception on a particular day of the week when the user's pattern of activity differs according to the day, and can improve the probability of successful reception in the automatic reception process.

Furthermore, when the automatic reception start time is set according to the day of the week, holiday information can also be considered in addition to the day of the week from Monday to Sunday. Holiday information varies by country, and can be set by identifying the country of the current location based on user input or positioning information obtained in the positioning mode.

Days of the week can also be grouped as work days and holidays. In this case, the work days and holidays could be set by default to Monday through Friday as work days, and Saturday and Sunday as holidays, while enabling the user to manually change the settings. This configuration enables determining that Tuesday to Friday are also work days even when the past reception history only contains information from Monday, and using the reception history from Monday to control automatic reception.

The fourth and fifth embodiments set the automatic reception start time based on the results of reception in a manual reception mode, but processes for changing or setting the automatic reception start time through the automatic reception processes as described in the first to third embodiments could be added to the fourth and fifth embodiments. In other words, the automatic reception start time is set based on the result of reception when reception is started manually, and after that the automatic reception start time can be changed based on the result of the automatic reception process.

By thus setting the automatic reception start time based on the result of a manual reception process, and setting the automatic reception start time based on the result of automatic reception processes, the automatic reception start time can be set appropriately regardless of which process is used.

The electronic timepiece according to the invention is not limited to analog timepieces having hands, and can also be applied to hybrid timepieces having both analog hands and a digital display, and to digital timepieces having only a digital display. The invention is also not limited to wristwatches, and can be adapted to table clocks, pocket watches, and other types of timepieces, cellular telephones, digital cameras, personal navigation devices, motor vehicle navigation devices, and other types of information terminals having a timekeeping function.

The power generating device of the foregoing embodiments is also not limited to a solar panel 70, and could be a device that drives a generator using a rotary pendulum.

Further alternatively, the storage battery 60 could be charged from an external power supply, such as a wall outlet, instead of providing the GPS wristwatch 1 with a power generating device.

The power supply is also not limited to a rechargeable storage battery, and a primary battery could be used instead.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning satellites that transmit satellite signals containing time information, including the SBAS and other geostationary or quasi-zenith satellites.

The invention being thus described, it will be obvious that it maybe varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2011-095178, filed Apr. 21, 2011 is expressly incorporated by reference herein.

What is claimed is:

1. An electronic timepiece comprising:

a reception unit that executes a first reception process for receiving a satellite signal sent from a positioning satellite and acquiring time information contained in the satellite signal;

a timekeeping unit that keeps time and adjusts the kept time based on the time information acquired in the first reception process when the first reception process succeeded; and a reception time setting unit that sets a reception start time for starting a second reception process based on a time at which the first reception process is executed when the first reception process succeeded; wherein the reception unit executes the second reception process for receiving a satellite signal sent from a positioning satellite and acquiring time information contained in the satellite signal when the time kept by the timekeeping unit matches the reception start time set by the reception time setting unit, the timekeeping unit adjusts the kept time based on the time information acquired in the second reception process when the second reception process succeeded, the reception time setting unit updates the reception start time by shifting the reception start time when the second reception process failed, the reception unit executes a third reception process for receiving a satellite signal sent from a positioning satellite and acquiring time information contained in the satellite signal when the time kept by the timekeeping unit matches the reception start time, and the reception time setting unit does not change the reception start time when the third reception process succeeded.

2. The electronic timepiece described in claim 1, wherein:

the reception unit executes the first reception process a plurality of times for a specific period of time, and the reception time setting unit sets the reception start time based on times at which some of the times the first reception process succeeded.

3. The electronic timepiece described in claim 1, wherein:

the reception unit executes the first reception process a plurality of times, and the reception time setting unit sets the reception start time based on a time at which the first reception process succeeded at least once.

4. The electronic timepiece described in claim 1, wherein:

the reception unit executes the first reception process a plurality of times for a specific period of time, and the reception time setting unit sets the reception start time based on some of the times at which the first reception process succeeded.

5. The electronic timepiece described in claim 1, wherein:

the reception unit executes the first reception process when an operating member is operated.

6. An electronic timepiece comprising:

a manual reception unit that executes a manual reception process for receiving a satellite signal from a positioning satellite and acquiring time information contained in the satellite signal when an operating member is operated;

a timekeeping unit that keeps time and adjusts the kept time based on the time information acquired in the manual reception process when the manual reception process succeeded;

a reception time setting unit that sets a reception start time for starting an automatic reception process based on a time at which the manual reception process is executed when the manual reception process succeeded; and an automatic reception unit that executes the automatic reception processes for receiving a satellite signal from a positioning satellite and acquiring time information contained in the satellite signal when the time kept by the timekeeping unit matches the reception start time set by the reception time setting unit;

wherein the timekeeping unit adjusts the kept time based on the time information acquired in the automatic reception process, and wherein the reception start time for starting the automatic reception process set at any time the manual reception was successful wherein the reception time setting unit does not set the reception start time based on time at which the automatic reception process is executed when the automatic reception process was successful.

7. The electronic timepiece described in claim 6, wherein:

the manual reception process is executed a plurality of times, and the reception time setting unit sets the reception start time based on times at which the manual reception process are successfully executed within a specific period of time.

8. The electronic timepiece described in claim 6, wherein:

the manual reception process is determined to fail when the positioning satellite is not found and the satellite signal is not received, or when the satellite signal is received but the time information is not acquired.

9. A time adjustment method comprising steps of:

executing a first reception process that receives a satellite signal sent from a positioning satellite and acquires time information contained in the satellite signal;

keeping time;

adjusting the kept time based on the time information acquired in the first reception process when the first reception process succeeded;

setting a reception start time for starting a second reception process based on a time at which the first reception process is executed when the first reception process succeeded;

executing the second reception process that receives a satellite signal from a positioning satellite and acquires time information contained in the satellite signal when the time kept by the timekeeping step matches the reception start time set by the reception time setting step;

updating the reception start time by shifting the reception start time when the second reception process failed;

executing a third reception process for receiving a satellite signal sent from a positioning satellite and acquiring time information contained in the satellite signal when the time kept matches the reception start time, and keeping the reception start time when the third reception process succeeded; and adjusting the kept time based on the time information acquired (i) in the second reception process when it succeeded and (ii) in the third reception process when it succeeded.

* * * * *